US010495375B2

(12) United States Patent
Kim

(10) Patent No.: US 10,495,375 B2
(45) Date of Patent: Dec. 3, 2019

(54) REFRIGERATOR

(71) Applicant: LG ELECTRONICS INC., Seoul (KR)

(72) Inventor: Yonghyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/609,327

(22) Filed: May 31, 2017

(65) Prior Publication Data

US 2017/0343275 A1 Nov. 30, 2017

(30) Foreign Application Priority Data

May 31, 2016 (KR) ..... 10-2016-0067799

(51) Int. Cl.

| | |
|---|---|
| ***F25D 23/12*** | (2006.01) |
| ***B67D 1/00*** | (2006.01) |
| ***B67D 1/08*** | (2006.01) |
| ***F25D 11/00*** | (2006.01) |
| ***F25D 23/02*** | (2006.01) |

(52) U.S. Cl.

CPC ..... *F25D 23/126* (2013.01); *B67D 1/0009* (2013.01); *B67D 1/0864* (2013.01); *B67D 1/0895* (2013.01); *F25D 11/00* (2013.01); *F25D 23/02* (2013.01); *F25D 23/028* (2013.01); *B67D 2210/00036* (2013.01); *F25D 2400/02* (2013.01)

(58) Field of Classification Search

CPC ..... F25D 23/126; F25D 23/02; F25D 11/00; F25D 23/028; F25D 2400/02; B67D 1/0009; B67D 1/0864; B67D 1/0895

See application file for complete search history.

(56) References Cited

U.S. PATENT DOCUMENTS 4,046,438 A * 9/1977 Benasutti ..... F25D 23/021 312/138.1
5,690,851 A * 11/1997 Yoshioka ..... H05B 6/105 219/624
7,137,272 B2 * 11/2006 Park ..... F25D 23/126 62/389
8,083,104 B2 * 12/2011 Roetker ..... B67D 1/0858 222/1
8,397,952 B2 * 3/2013 Kim ..... F25D 23/126 222/146.1

(Continued)

FOREIGN PATENT DOCUMENTS

KR 20050051970 B1 6/2005
KR 0539563 B1 12/2005

(Continued)

*Primary Examiner* — David P Angwin
*Assistant Examiner* — Bob Zadeh
(74) *Attorney, Agent, or Firm* — Fish & Richardson P.C.

(57) ABSTRACT

A refrigerator includes a cabinet, a door, and a dispenser located at the door. The dispenser includes a dispenser case located at an outer surface of the door, an extraction nozzle located at an upper portion of a recessed part of the dispenser, a hot water module located at a rear portion of or behind the recessed part, and a hot water module case that accommodates the hot water module. The hot water module is configured to heat, by induction heating, water supplied to the hot water module and to supply the heated water to the extraction nozzle, and the hot water module case couples to a rear wall of the dispenser case.

20 Claims, 8 Drawing Sheets

(56) References Cited

U.S. PATENT DOCUMENTS

| | | | | |
|---|---|---|---|---|
| 8,651,331 | B2 * | 2/2014 | Krause | B67D 1/0858 222/129 |
| 9,216,895 | B2 * | 12/2015 | Bertolini | B67D 7/82 |
| 9,254,058 | B2 * | 2/2016 | Bird | F25D 23/126 |
| 2006/0080991 | A1 * | 4/2006 | An | B01D 35/18 62/389 |
| 2006/0144066 | A1 * | 7/2006 | Lee | F25D 23/12 62/238.6 |
| 2008/0148763 | A1 * | 6/2008 | Boarman | F25D 23/126 62/389 |
| 2010/0066226 | A1 * | 3/2010 | Luisi | F25D 23/126 312/405.1 |
| 2010/0082159 | A1 * | 4/2010 | Kim | F25C 5/22 700/275 |
| 2015/0101670 | A1 * | 4/2015 | Bird | F25D 23/12 137/1 |
| 2015/0136803 | A1 * | 5/2015 | Bertolini | B67D 7/82 222/1 |
| 2015/0323221 | A1 * | 11/2015 | Gaspard | F24H 1/121 219/628 |
| 2017/0343275 | A1 * | 11/2017 | Kim | F25D 23/126 |

FOREIGN PATENT DOCUMENTS

| | | | |
|---|---|---|---|
| KR | 10-0614227 | | 8/2006 |
| KR | 01326703 | B1 | 11/2013 |
| KR | 20160001614 | B1 | 1/2016 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2016-0067799 filed in Korea on May 31, 2016, which is hereby incorporated by reference in its entirety.

FIELD

The present disclosure relates to a refrigerator.

BACKGROUND

A refrigerator is a home appliance that can store foods at a low temperature in an internal storage space closed by a door. The refrigerator can cool the inside of the storage space using cool air generated through heat exchanging with a refrigerant that circulates through a refrigerating cycle.

Various devices for convenience of a user may be provided in the refrigerator. For example, a dispenser may be provided at the door.

The dispenser enables the user to extract purified water or ice at the outside of the door. The dispenser may be configured to dispense cold water, purified water, or ice depending on a selection of the user.

A refrigerator may include a hot water heater at an upper side of a door provided with a dispenser, to provide hot water through the dispenser.

In a refrigerator including the hot water heater that is attachable/detachable, the thickness of the door may be increased. If the thickness of the door is maintained, the heat insulating performance of the door may degrade, and power consumption may increase.

In some examples, the entire flow path for supplying hot water may be long and complicated. When hot water is extracted, heat loss may occur through the long flow path, and therefore, the temperature of the hot water may decrease.

In some examples where the hot water heater does not measure the temperature of input water, the hot water may not be discharged at a constant temperature.

SUMMARY

According to one aspect of the subject matter described in this application, a refrigerator includes a cabinet that defines a storage space; a door configured to open and close at least a portion of the storage space, the door including an out plate that defines an outer appearance of the door, a door liner that defines an inner surface of the door, and a heat insulating material that is filled in a space defined between the out plate and the door liner; and a dispenser located at the door and configured to dispense water or ice to an outside of the door. The dispenser includes: a dispenser case located at an outer surface of the door, the dispenser case defining an appearance of the dispenser and including a recessed part recessed from the outer surface of the door; an extraction nozzle located at an upper portion of the recessed part, the extraction nozzle being configured to enable flow of water to the outside of the door; a hot water module located at a rear portion of the recessed part or behind the recessed part, the hot water module being configured to heat, by induction heating, water supplied to the hot water module and to supply the heated water to the extraction nozzle; and a hot water module case that accommodates the hot water module, the hot water module case coupling to a rear wall of the dispenser case.

Implementations according to this aspect may include one or more of the following features. At least a portion of the hot water module case may be surrounded by the heat insulating material. The dispenser may further include a cold water module mounting part that is recessed from a portion of the door liner and located rearward of the hot water module, and a door auxiliary cooling tank that is mounted to the cold water module mounting part and that is configured to cool water supplied to the door auxiliary cooling tank and to store the cooled water.

In some implementations, the dispenser may further include a door cover that is located at the door liner and defines a portion of the inner surface of the door, the door cover covering the cold water module mounting part. In some cases, the door auxiliary cooling tank may have a wound tube shape and is located at a surface of the door cover. In some examples, the extraction nozzle may include a hot water extraction nozzle connected to the hot water module and configured to dispense hot water and a cold/purified water extraction nozzle connected to the cold water module and configured to dispense cold water, purified water, or both.

In some implementations, the hot water module may include: a hot water tank that is configured to receive purified water and to pass the received purified water therethrough; a working coil that faces the hot water tank, that is wound multiple times about a center of the working coil, and that is configured to generate an electromagnetic field for heating the hot water tank by induction heating; a plurality of ferrite cores that are radially disposed about the center of the working coil and configured to maintain the electromagnetic field generated by the working coil; and a heating bracket that is coupled to the hot water tank, the working coil, and the plurality of ferrite cores.

In some implementations, the hot water module may further include a control assembly that is coupled to the heating bracket and configured to control an operation of the hot water module. In this case, the hot water tank may face toward the recessed part, and the control assembly may face toward the storage space and be located rearward of the hot water tank. The hot water tank may face toward the rear wall of the dispenser.

In some implementations, the hot water module may include a safety valve located at an exit of the hot water tank, the safety valve being configured to communicate with the dispenser to discharge steam from the hot water tank. In some cases, the hot water module may further include a flow rate control valve located at an entrance of the hot water tank, the flow rate control valve being configured to measure a flow rate of water supplied to the hot water tank.

In some implementations, the hot water module further includes a water inlet temperature sensor located at an entrance of the hot water tank, the water inlet temperature sensor being configured to measure a temperature of water supplied to the hot water tank. The hot water tank may include a first cover that has a planar shape and faces the working coil, and a second cover that faces the first cover and couples to a circumferential surface of the first cover, at least a portion of the second cover being recessed to define a space between the first and second covers. In this case, the hot water tank may be configured to enable flow of water through the defined space between the first and second covers.

In some examples, the dispenser may further include a cold water module located at the door, the cold water module being configured to cool water supplied to the dispenser and to store the cooled water, where the hot water module is disposed between the recessed part and the cold water module.

According to another aspect of the subject matter described in this application, a refrigerator includes a cabinet that defines a storage space; a door configured to open and close at least a portion of the storage space, the door including an out plate that defines an outer appearance of the door, a door liner that defines an inner surface of the door, and a heat insulating material that is filled in a space defined between the out plate and the door liner; and a dispenser provided at the door and configured to dispense water or ice to an outside of the door. The dispenser includes: a dispenser case located at an outer surface of the door, the dispenser case defining an appearance of the dispenser and a space recessed from the outer surface of the door; a wall plate detachably coupled to the dispenser case, the wall plate partitioning the recessed space into a recessed part in front of the wall plate and a hot water module mounting part behind the wall plate; an extraction nozzle extending from an upper portion of the recessed part, and the extraction nozzle being configured to enable flow of water to the outside of the door; and a hot water module located at the hot water module mounting part, a hot water module being configured to heat, by induction heating, water supplied to the hot water module and to supply the heated water to the extraction nozzle.

Implementations according to this aspect includes one or more of following features. The wall plate may define a rear wall of the recessed part. The dispenser case may include a mounting part, and the wall plate may be detachably coupled to the mounting part. In some cases, the dispenser case may have an opening at a front side of the recessed part, and the wall plate may be detachable from the dispenser case through the opening.

In some implementations, the dispenser may further include an extraction manipulating member that is located at the wall plate and configured to enable flow of water through the extraction nozzle.

In some implementations, the hot water module may include: a hot water tank; a working coil that faces the hot water tank, that is wound multiple times about a center of the working coil, and that is configured to generate an electromagnetic field for heating the hot water tank by induction heating; a plurality of ferrite cores that are radially disposed about the center of the working coil and configured to maintain the electromagnetic field generated by the working coil; and a heating bracket that is coupled to the hot water tank, the working coil, and the plurality of ferrite cores. In some cases, the hot water tank may face toward the wall plate.

DETAILED DESCRIPTION

In the present disclosure, a bottom freezer type refrigerator in which a freezing compartment is provided at a lower side of a refrigerating compartment is illustrated as an example for convenience of description and understanding, but the present disclosure is applicable to all types of refrigerators that have a dispenser provided at a door thereof.

Figure 1:
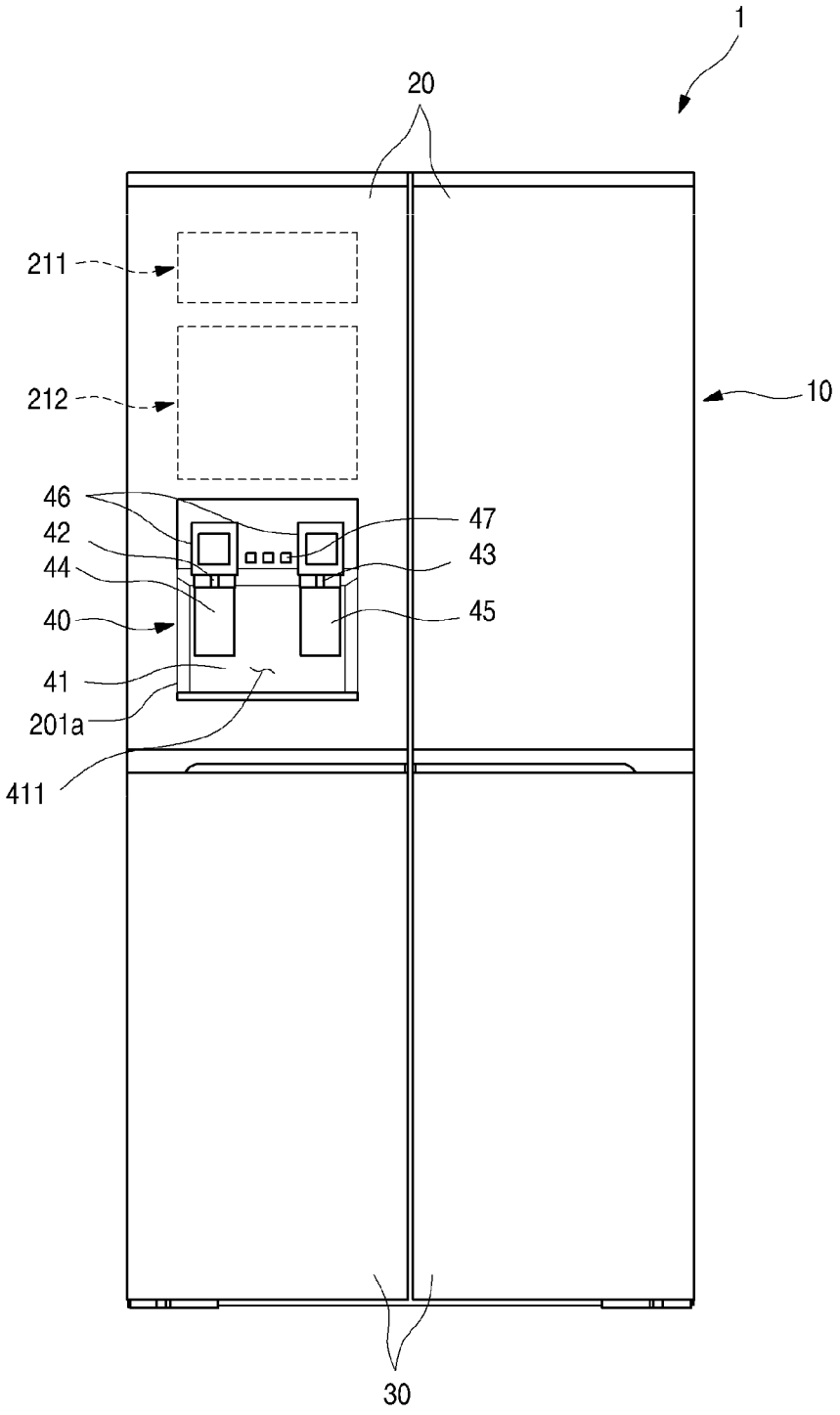
FIG. 1 is a front view showing an example refrigerator.
Figure 2:
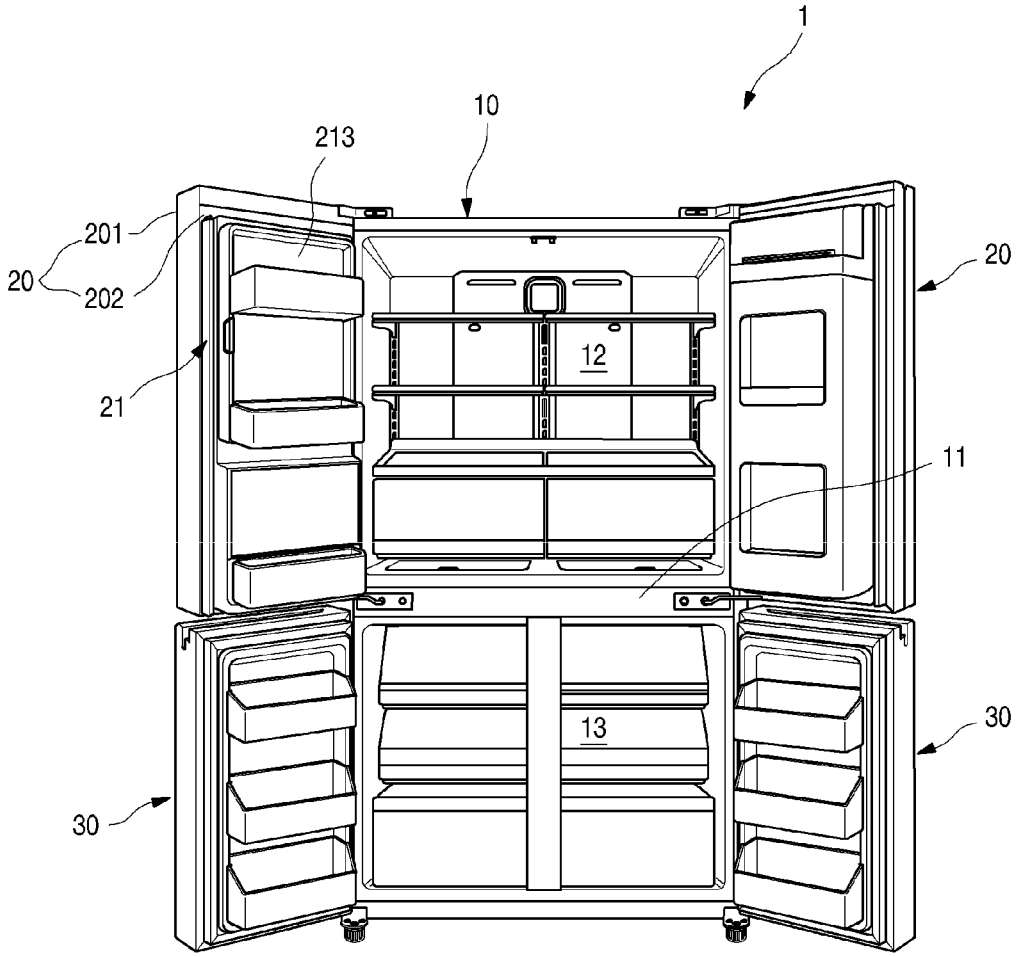
FIG. 2 is a view showing the example refrigerator and example doors.

FIG. 1 illustrates an example refrigerator. FIG. 2 illustrates the refrigerator and example doors that are open.

As shown in the drawings, the overall appearance of the refrigerator 1 may be formed by a cabinet 10 having a storage space formed therein and a door 20 and 30 that opens/closes the storage space formed in the cabinet 10.

The cabinet 10 may be formed in a hexahedral shape having an opened front surface, and the storage space in the cabinet 10 may be vertically divided by a barrier 11. That is, based on the barrier 11, a refrigerating compartment 12 may be formed at an upper portion of the cabinet 10, and a freezing compartment 13 may be formed at a lower portion of the cabinet 10.

Components constituting a freezing cycle may be provided in the cabinet 10, and cool air heat-exchanged in an evaporator is supplied to the refrigerating compartment 12 and the freezing compartment 13, to cool the interior of the refrigerator. In some examples, a plurality of shelves and baskets for receiving foods may be provided in the refrigerating compartment 12 and the freezing compartment 13.

The door 20 and 30 may include a refrigerating compartment door 20 that opens/closes the refrigerating compartment 12 and a freezing compartment door 30 that opens/closes the freezing compartment 13. In some examples, the refrigerating compartment door 20 may be provided in a pair at both left and right sides, and the pair of refrigerating compartment doors 20 may be rotatably mounted at both sides of the cabinet 10, respectively. In some cases, the refrigerating compartment door 20 may allow the refrigerating compartment 12 to be selectively opened/closed by rotation thereof. The pair of refrigerating compartment doors 20 may be independently rotated, and a front surface of the refrigerating compartment 12 may be partially opened/closed.

Like the refrigerating compartment door 20, the freezing compartment door 30 may be provided in a pair, and be rotatably mounted to the cabinet 10 to allow the freezing compartment 13 to be opened/closed by rotation thereof. In some examples, the freezing compartment door 30 may allow the freezing compartment 13 to be opened/closed by a sliding push/pull manner instead of a rotation manner, if necessary.

In some implementations, a plurality of door baskets or reception spaces may be provided at rear surfaces of the refrigerating compartment door 20 and the freezing compartment door 30.

In some implementations, an ice making compartment 21 may be provided at the refrigerating compartment door 20. The ice making compartment 21 may be provided at an upper portion of a rear surface of the door 20 and 30, and form a heat insulating space that is independent from the inside of the refrigerating compartment 12. In some cases, the ice making compartment 21 may receive cool air supplied from at one side of the cabinet 10, which is in contact with the refrigerating compartment door 20 in a state in which the refrigerating compartment door 20 is closed, to be cooled to a temperature at which ice can be made or a temperature at which the made ice can be stored. An ice making compartment door 213 is provided to the ice making compartment 21 to allow the ice making compartment 21 to be opened/closed. In some examples, an ice maker 211 that can make ice and an ice bank 212 that stores ice and enables the stored ice to be supplied to a dispenser 40 may be provided in the ice making compartment 21.

In some implementations, the ice making compartment 21 may be provided at any one of the pair of refrigerating compartment doors 20, and the dispenser 40 may also be provided at the refrigerating compartment door 20 at which the ice making compartment 21 is provided.

The dispenser 40 may be provided at a front surface of the refrigerating compartment door 20, and be formed at a lower portion of the refrigerating compartment door 20. In some cases, the dispenser 40 communicates with the ice making compartment 21 to enable ice stored in the ice making compartment 21 to be extracted at the outside of the refrigerating compartment door 20. In some examples, the dispenser 40 may allow hot water as well as purified water and cold water to be extracted therefrom.

In some implementations, the dispenser 40 may be connected to a flow path along which purified water, cold water, and hot water can be supplied thereto, and a filter 121 (see FIG. 7) for purifying water and a cooling tank 122 (see FIG. 7) for storing cold water may be provided in the cabinet 10.

In some implementations, in the dispenser 40, a space recessed in the front surface of the refrigerating compartment door 20 may be formed by a dispenser case 41. That is, a recessed part 411 may be formed in the dispenser case 41. In some examples, a hot water extraction nozzle 42 and a cold/purified water extraction nozzle 43 may be provided at the recessed part 411. In order to decrease the influence caused by remaining water in extraction of hot water and cold/purified water and efficiently arrange flow paths, the hot water and cold/purified water may be extracted through the independent nozzles 42 and 43, respectively.

In some implementations, a hot water extraction member 44 and a cold/purified water extraction member 45 may be provided at lower sides of the hot water extraction nozzle 42 and the cold/purified extraction nozzle 43, respectively. The hot water extraction member 44 and the cold/purified water extraction member 45 has a structure such as a lever, and enable hot water and cold/purified water to be independently extracted by extraction by extraction manipulations, respectively.

In some implementations, a display 46 capable of displaying an operation state of the dispenser 40 or the refrigerator 1 may be further provided at an upper portion of the dispenser case 41. In some cases, separate manipulation buttons 47 for manipulating operations and settings of the refrigerator 1 or the display 46 may be further provided at the dispenser case 41.

Figure 3:
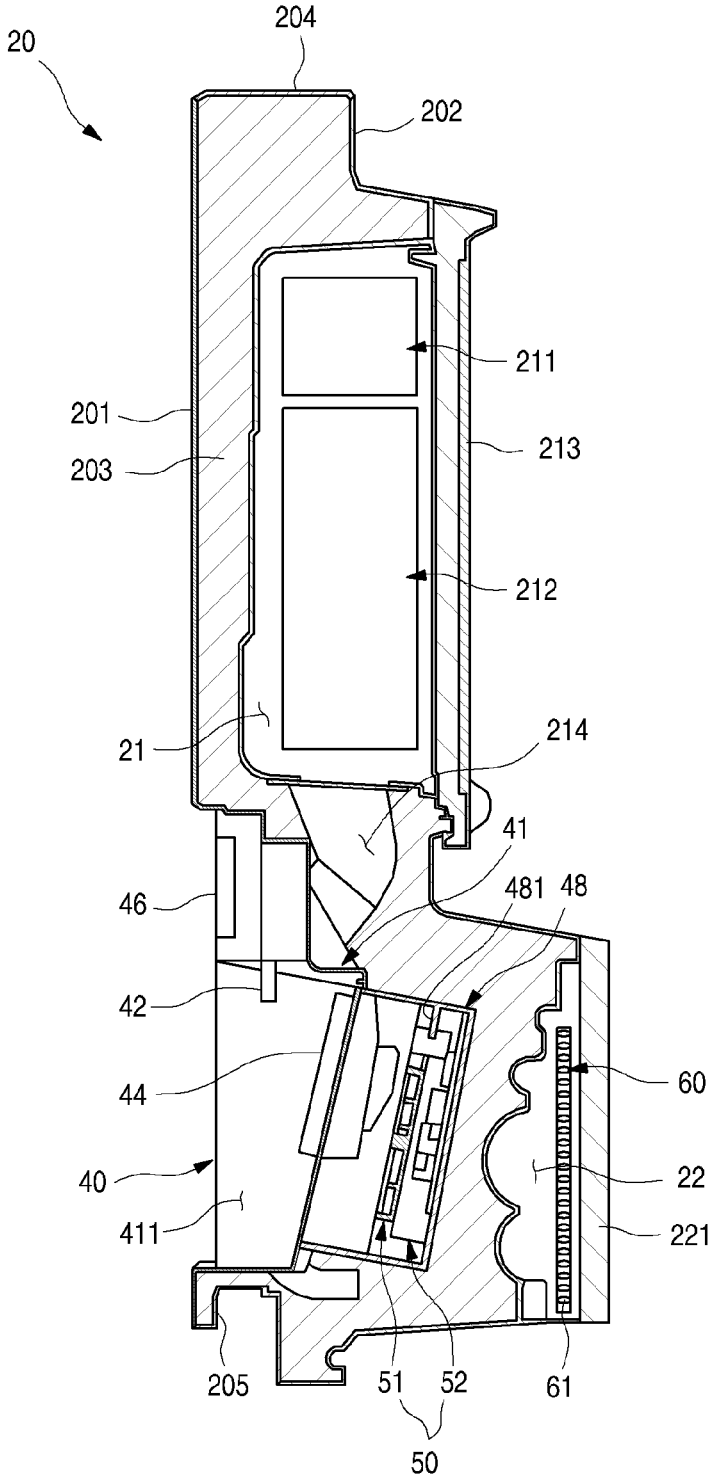
FIG. 3 is a longitudinal cross-sectional view of one of the example doors.
Figure 4:
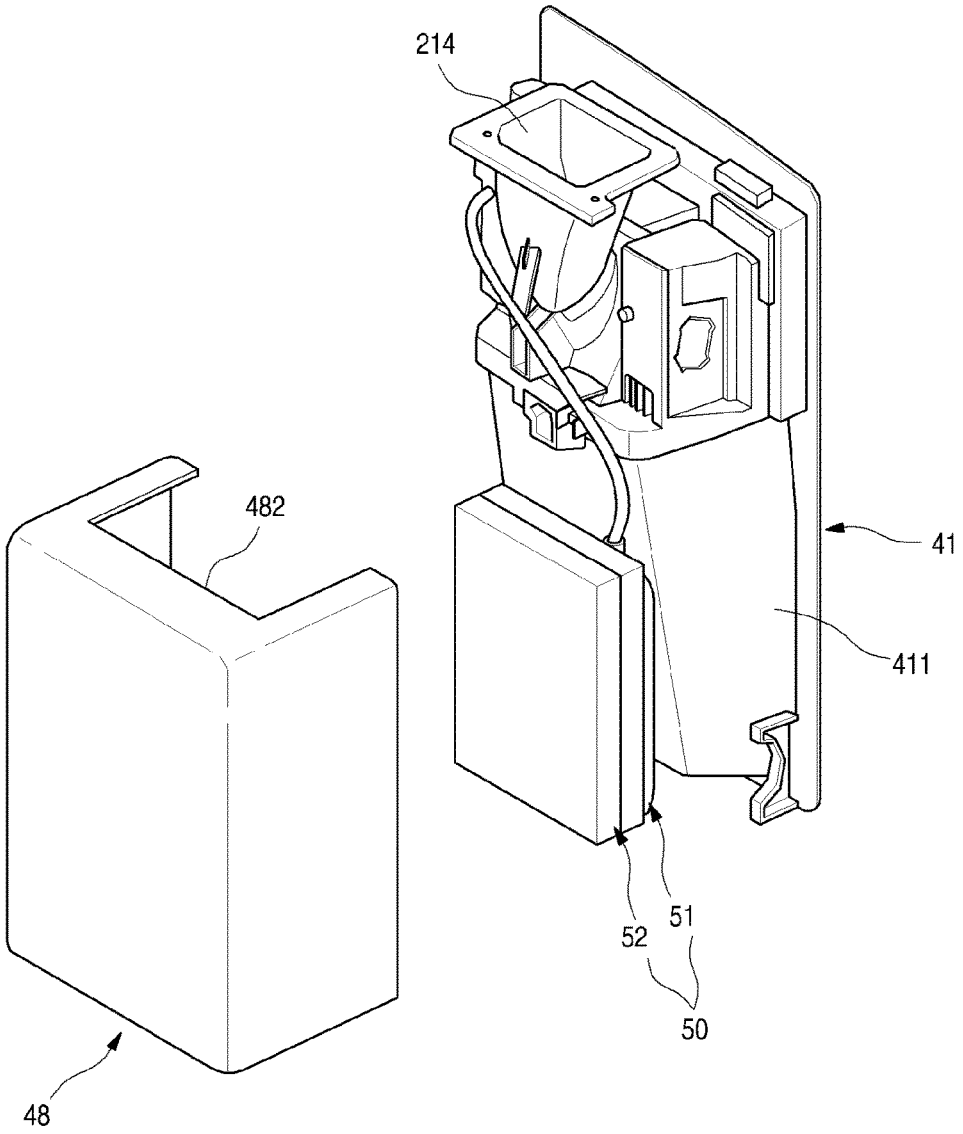
FIG. 4 is a perspective view showing an example hot water module and its mounting status.

FIG. 3 is a longitudinal cross-sectional view of the example door. FIG. 4 is a perspective view illustrating an example mounting state of an example hot water module.

As shown in the drawings, the refrigerating compartment door 20 may include an out plate 201 that forms a front appearance thereof and a door liner 202 spaced apart from the out plate 201 to form a rear surface thereof. In some cases, a heat insulating material 203 is formed by injecting a foaming solution into a space between the out plate 201 and the door liner 202. In this case, the refrigerating compartment door 20 may be insulated such that the refrigerating compartment 12 is not heat-exchanged with external air. In some cases, upper and lower surfaces of the refrigerating compartment door 20 may be formed by cap decorations 204 and 205.

The out plate 201 may be made of a plate-shaped metallic material. In some cases, the out plate 201 may be made of a plastic material having a film attached thereto or be formed various materials such as glass. In some examples, the door liner 202 may be injection-molded with a plastic material. The door liner 202 may form the ice making compartment 21 in the injection molding thereof, and be formed to provide a structure in which a plurality of door baskets are mounted.

In some implementations, a dispenser opening 201*a* that enables the dispenser case 41 to be mounted therein may be formed at a front lower portion of the out plate 201. The dispenser opening 201*a* may be formed opened in a shape corresponding to the dispenser case 41. The dispenser opening 201*a* may be covered by the dispenser case 41 in a state in which the dispenser case 41 is mounted in the dispenser opening 201*a*.

When the dispenser case 41 is mounted, the recessed part 411 may have a structure recessed in an inner surface of the door 20 and 30. In some cases, the hot water extraction member 44 and the cold/purified water extraction member 45 may be mounted on a recessed rear wall of the recessed part 411.

In some implementations, a chute part 214 may be formed at an upper portion of the dispenser case 41. The chute part 214 forms a passage communicating with the ice making compartment 21, and provides a passage through which ice stored in the ice making compartment 21 can be extracted.

In some examples, a display part may be formed at a front upper end of the dispenser case 41. The display 46 may be mounted at the display part, and a plurality of manipulation buttons 47 may be mounted at the display part.

In some implementations, a hot water module case 48 may be provided at the rear of the recessed part 411 of the dispenser case 41. The hot water module case 48 may form a space in which a hot water module 50 can be accommodated, and be fixed to a rear surface of the recessed part 411 of the dispenser case 41. That is, the hot water module 50 may be mounted in a rear space of the dispenser case 41.

In some implementations, the hot water module case 48 may be formed in a shape having an opened front surface, and the front end of the hot water module 50 may extend to be coupled to a rear surface of the hot water case 48, more specifically, the rear surface of the recessed part 411. In some examples, a module fixing part 481 for fixing the hot water module 50 may be further formed in the hot water module case 48.

In some cases, the hot water case 48 may be mounted in the dispenser case 41. In these cases, if the heat insulating material 203 is filled in the refrigerating compartment door 20, the hot water module case 48 may be buried in the heat insulating material 203.

Thus, heat that may be generated during an operation of the hot water module 50 can be insulated by the heat insulating material 203, and be prevented from penetrating into the refrigerating compartment 12. In some examples, a cold water module 60 including an auxiliary cooling tank 661 (see FIG. 7) is disposed at the rear of the hot water module case 48, so that heat generated in the operation of the hot water module 50 can be effectively prevented from penetrating into the refrigerating compartment 12.

In some examples, a coupling part 482 formed in a shape corresponding to that of a rear surface of the dispenser case 41 may be further formed at the front end of the hot water module case 48. The coupling part 482 may be recessed to be located close to the rear surface of the dispenser case 41, and prevent the heat insulating material 203 from penetrating into the hot water module case 48 in a case where the coupling part 482 is coupled to the dispenser case 41.

In some implementations, a cold water module mounting part 22 is recessed inward to accommodate the cold water module 60, and the cold water module mounting may be located at a rear half of the refrigerating compartment door 20, for example, the door liner 202 at a position corresponding to the dispenser case 41. In some cases, the cold water module mounting part 22 may include the auxiliary cooling tank 661 in which cold water supplied to the dispenser 40 and the ice maker 211 is additionally cooled and a plurality of valves switched to supply cold water and purified water.

In some implementations, the cold water module mounting part 22 may be opened to the rear of the refrigerating compartment door 20, and a door cover 221 may be provided at a rear surface of the cold water module mounting part 22. The opened rear surface of the cold water module mounting part 22 may be covered by the door cover 221.

In some implementations, the hot water module 50 is provided to heat purified water, and is configured to heat the purified water in an induction heating (IH) manner. In some cases, the hot water module 50 can quickly heat water in response to manipulation of hot water extraction to provide a user with purified water that is heated to a desired temperature by controlling the output of a magnetic field. Accordingly, hot water having the desired temperature can be dispensed.

Figure 5:
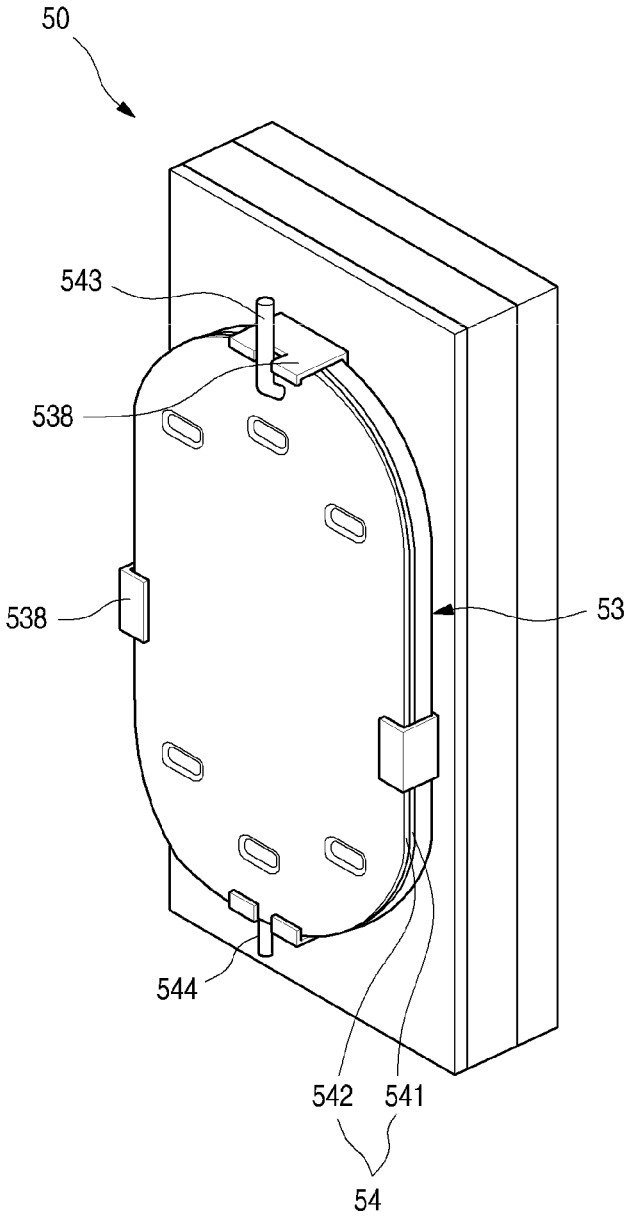
FIG. 5 is a perspective view showing the example hot water module.
Figure 6:
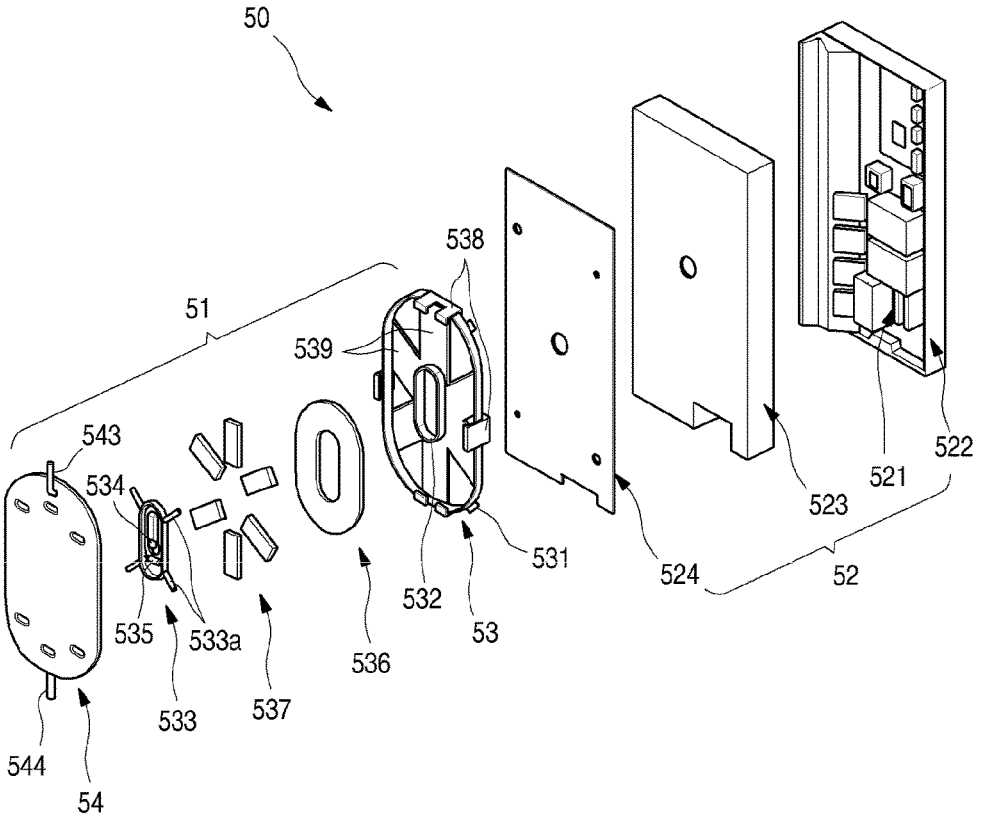
FIG. 6 is an exploded perspective view showing the example hot water module.

FIG. 5 is a perspective view illustrating the example hot water module. FIG. 6 is an exploded perspective illustrating the example hot water module.

As shown in the drawings, the hot water module 50 may include an induction heating assembly 51 for producing hot water and a control assembly 52 for controlling driving of the induction heating assembly 51. The induction heating assembly 51 and the control assembly 52 may be coupled to each other as one module. The induction heating assembly 51 and the control assembly 52 may be mounted in the hot water module case 48 in the state in which they are coupled to each other.

In some implementations, when the hot water module 50 is mounted, the hot water module 50 may be configured such that the induction heating assembly 51 faces the dispenser case 41. The induction heating assembly 51 that generates heat by driving the hot water module 50 may face the dispenser case 41 to reduce heat transfer to the rear surface of the refrigerating compartment door 20 and to the inside of the refrigerating compartment 12.

In some cases, the induction heating assembly 51 is used to heat water that is purified by passing through the filter 121. The induction heating assembly 51 is configured to heat water in the IH manner.

The induction heating assembly 51 may include a hot water tank 54 through which purified water passes, a working coil 536 for heating water passing through the hot water tank 54, and a heating bracket 53 to which the working coil 536 and the hot water tank 54 are mounted.

The heating bracket 53 along with the hot water tank 54 provides a mounting space of the working coil 536 and ferrite cores 537. In some examples, the heating bracket 53 may be made of a resin material that is not deformed or damaged even at high temperature.

The heating bracket 53 may have core fixing parts 539 radially disposed about a bracket mounting part 532 at the center thereof. The core fixing part 539 may extend up to the rim of the heating bracket 53 from the bracket mounting part 532, and a plurality of core fixing parts may be radially arranged. In this case, the arrangement of the core fixing parts 539 may be formed to correspond to that of the ferrite cores 537.

In some examples, tank fixing parts 538 may be formed at the rim of the heating bracket 53. The tank fixing parts 538 may extend forward from the rim of the heating bracket 53 toward the hot water tank 54 and couple to the circumference of the hot water tank 54. Thus, the hot water tank 54 can be configured as a module by being coupled to the heating bracket 53, and be heated by maintaining a setting or predetermined distance from the working coil 536.

A bracket coupling part 531, for coupling the heating bracket 53 to the control assembly 52, is formed at an edge of the heating bracket 53. In some cases, the bracket coupling part 531 may be provided in a plurality, and extending end portion of the plurality of bracket coupling parts 531 may have different shapes from each other and be formed to have directivity. Thus, the induction heating assembly 51 can have a structure coupled to the control assembly 52, and be mounted at an accurate position.

The bracket mounting part 532, for mounting a mounting bracket 533 to the heating bracket 53, may be further formed at the center of one surface of the heat bracket 53 to which the hot water tank 54 is mounted. In some implementations, a tank temperature sensor 534 and a fuse 535 may be provided at the center of the bracket mounting part 532.

In some implementations, the tank temperature sensor 534 that is configured to measure a temperature of the hot water tank may be mounted in the mounting bracket 533. The tank temperature sensor 534 can measure a temperature of the center of the hot water tank 54 so that a temperature of hot water can be determined without directly measuring the temperature of the hot water in the hot water tank 54. The temperature of extracted hot water can be maintained in a proper range by the tank temperature sensor 534. For example, whether heating needs to be additionally performed or whether the heating is to be stopped can be determined and controlled based on a temperature sensed by the tank temperature sensor 534.

In some examples, the fuse 535 may be mounted in the mounting bracket 533. The fuse 535 cuts off the power of the induction heating assembly 51 when water in the hot water tank 54 is excessively heated.

A plurality of coil fixing parts **533*a* may be formed at the circumference of the mounting bracket 533. The coil fixing parts 533*a* may extend outward from an outer surface of the mounting bracket 533. The coil fixing parts 533*a* may extend to fix the working coil 536 mounted in the heating bracket 53. Two coil fixing parts 533*a* may be provided at each of upper and lower portions of the mounting bracket 533. The coil fixing parts 533*a* may extend in a diagonal direction at both edges of the mounting bracket 533, to fix the working coil 536 by pressing the working coil 536**.

The working coil 536 may be provided at a front surface of the heating bracket 53. The working coil 536 can induce lines of magnetic force or electromagnetic fields, which cause the generation of heat of the hot water tank 54. When electric current is supplied in the working coil 536, lines of magnetic force or electromagnetic fields can be induced by the working coil 536. The lines of magnetic force or electromagnetic fields may have an influence (e.g., Joule-heating, induction-heating) on the hot water tank 54 so that the hot water tank 54 can generate heat due to the influence of the lines of magnetic force or electromagnetic fields.

The working coil 536 is disposed at the front surface of the heating bracket 53. The working coil 536 is disposed to face one of both surfaces of the hot water tank 54, the one surface having a planar shape. Also, the working coil 536 is configured with several strands of copper or another conductor wire, and the strands are insulated from each other. The working coil 536 allows an electromagnetic field or lines of magnetic force to be formed by current applied thereto.

In some implementations, the front surface of the hot water tank 54 which faces the working coil 536 may generate heat due to the influence of the lines of magnetic force or electromagnetic fields formed by the working coil 536. In FIG. 6, the strands of the working coil 536 are not illustrated in detail, but the outline of the working coil 536 formed by winding each strand around the outside of the bracket mounting part 532 is illustrated.

In some implementations, the ferrite cores 537 may be provided at a front surface of the working coil 536. The ferrite cores 537 are used to prevent loss of current or maintain the electromagnetic fields, and serve as a shielding film of the lines of magnetic force or electromagnetic fields. The working coil 536 may include a plurality of ferrite cores 537, and the plurality of ferrite cores 537 may be radially arranged about a central portion of the working coil 536.

The ferrite core 537 may be fixed to the core fixing part 539 of the heating bracket 53. The ferrite core 537 may be coupled to the core fixing part 539, or be press-fitted or coupled to the core fixing part 539. A plurality of core fixing parts 539 may be radially formed corresponding to the arrangement of the ferrite cores 537.

In some examples, the tank fixing parts 538 to which end portions of the hot water tank 54 are held and fixed in the state in which the hot water tank 54 is mounted to the heating bracket 53 may be further formed at the circumference of the heating bracket 53. Thus, the working coil 536, the ferrite cores 537, the mounting bracket 533, and the hot water tank 54 can be coupled in the form of one module in the state in which they are mounted to the heating bracket 53.

The hot water tank 54 may be mounted at the front surface of the heating bracket 53. The hot water tank 54 is configured to generate heat due to the influence (e.g., Joule-heating, induction-heating) of the lines of magnetic force or electromagnetic fields, which are formed by the working coil 536. Thus, purified water becomes hot water by being heated while it is passing through an internal space of the hot water tank 54.

In some examples, the hot water tank 54 may be formed in a flat and compact shape. In some cases, the hot water tank 54 is formed in a shape corresponding to the shape of the induction heating assembly 51, to be effectively heated in driving of the induction heating assembly 51.

In detail, the hot water tank 54 may be configured such that the circumference of a plate-shaped first tank part 541 having a planar shape and the circumference of a plate-shaped second tank part 542 of which at least one portion is recessed to form a flow path are joined with each other. In some examples, an output tube 543 through which heated water discharged from the hot water tank 54 is formed at an upper end of the hot water tank 54, and an input tube 544 through which water to be heated is supplied to the hot water tank 54 is formed at a lower end of the hot water tank 54. Thus, the hot water tank 54 can be instantaneously or quickly heated by heating caused by lines of magnetic force or electromagnetic fields formed in the working coil 536, and water can be heated while flowing through the water tank 54 that is heated. That is, water is introduced to the water tank 54 through the input tube 544, heated in the water tank 54, and discharged from the water tank 54 through the output tube 543. In some cases, hot water can be discharged from the hot water tank 54.

In some implementations, a safety valve 643 may be provided on the output tube 543 or a tube connected to the output tube 543. The safety valve 643 is used to discharge steam generated when hot water is heated in the hot water tank 54 and can prevent or limit the pressure in the hot water tank 54 from being excessively increased by steam. The safety valve 643 is configured to be opened at a set pressure, and may have various structures in which steam in the hot water tank 54 can be smoothly discharged. In some examples, an exit of the safety valve 643 may be connected to a bottom surface of the recessed part 411 of the dispenser 40 where remaining water can be collected, or to another side of the recessed part 411 of the dispenser 40.

In some implementations, a flow rate control valve 641 (see FIG. 7) may be provided on the input tube 544 or a tube connected to the input tube 544. The flow rate control valve 641 is used to control the flow rate of water supplied to the hot water tank 54, and may control the temperature of heat water passing through the hot water tank 54 to a certain temperature or higher.

In detail, when the amount of water passing through the hot water tank 54 is excessively large, water passing through the hot water tank 54 at high speed cannot be effectively heated while passing through the hot water tank 54. In this situation, the temperature condition of hot water may or may not be satisfied.

Therefore, when high-temperature hot water is to be extracted, water may be heated by controlling the amount of water supplied to the hot water tank 54. In some examples, when the temperature of the supplied water is excessively low, the heating performance of the hot water tank 54 may be enhanced by reducing the amount of the supplied water.

In some implementations, although not shown in detail in the drawings, a water inlet temperature sensor 642 may be provided at the flow rate control valve 641 or any one of an entrance and an exit of the flow rate control valve 641, and the opening of the flow rate control valve 641 may be controlled by the water inlet temperature sensor 642.

The control assembly 52 may be provided at the rear of the induction heating assembly 51. The control assembly 52 is used to control driving of the induction heating assembly 51 and a plurality of valves connected to the induction heating assembly 51, and may include a control Printed Circuit Board (PCB) 521, a control case 522, and a control cover 523.

The control PCB 521 is used to control operations or driving of the induction heating assembly 51, and may be mounted in the control case 522. Also, the control PCB 521 may control operations or driving of the valves connected to the induction heating assembly 51.

The control case 522 accommodates the control PCB 521 therein, and an opened surface of the control case 522 may be covered by the control cover 523. Thus, the control PCB 521 can maintain the accommodated state when the control case 522 and the control cover 523 are coupled to each other.

In some examples, the control case 522 may be coupled and fixed to the hot water module case 48 at the inside of the hot water module case 48. Therefore, the mounting position of the hot water module 50 may be determined by coupling between the control case 522 and the hot water module 50. In this case, the control case 522 may be disposed close to an inner rear surface of the hot water module case 48, and be disposed at a position most distant from the recessed part 411. In some examples, the induction heating assembly 51, for example, the hot water tank 54 may be disposed at a position closest to the recessed part 411. In some cases where the hot water tank 54 is a part having the highest temperature in the induction heating assembly 51, the hot water tank 54 may be disposed at a position closest to the recessed part 411 so as to minimize the influence on the temperature in the refrigerator.

In some implementations, a shield plate 524 may be provided at a front surface of the control cover 523. The shield plate 524 is configured to absorb or block lines of magnetic force or electromagnetic fields from being transferred to the control PCB 521 in the driving of the induction heating assembly 51, and may be formed at the front surface of the control cover 523. In some cases, the shield plate 524 may cover the entire front surface of the control cover 523. The shield plate 524 may be molded in a separate sheet shape, and be mounted to the front surface of the control cover 523.

Hereinafter, an example flow path of water of the example refrigerator described above will be described.

Figure 7:
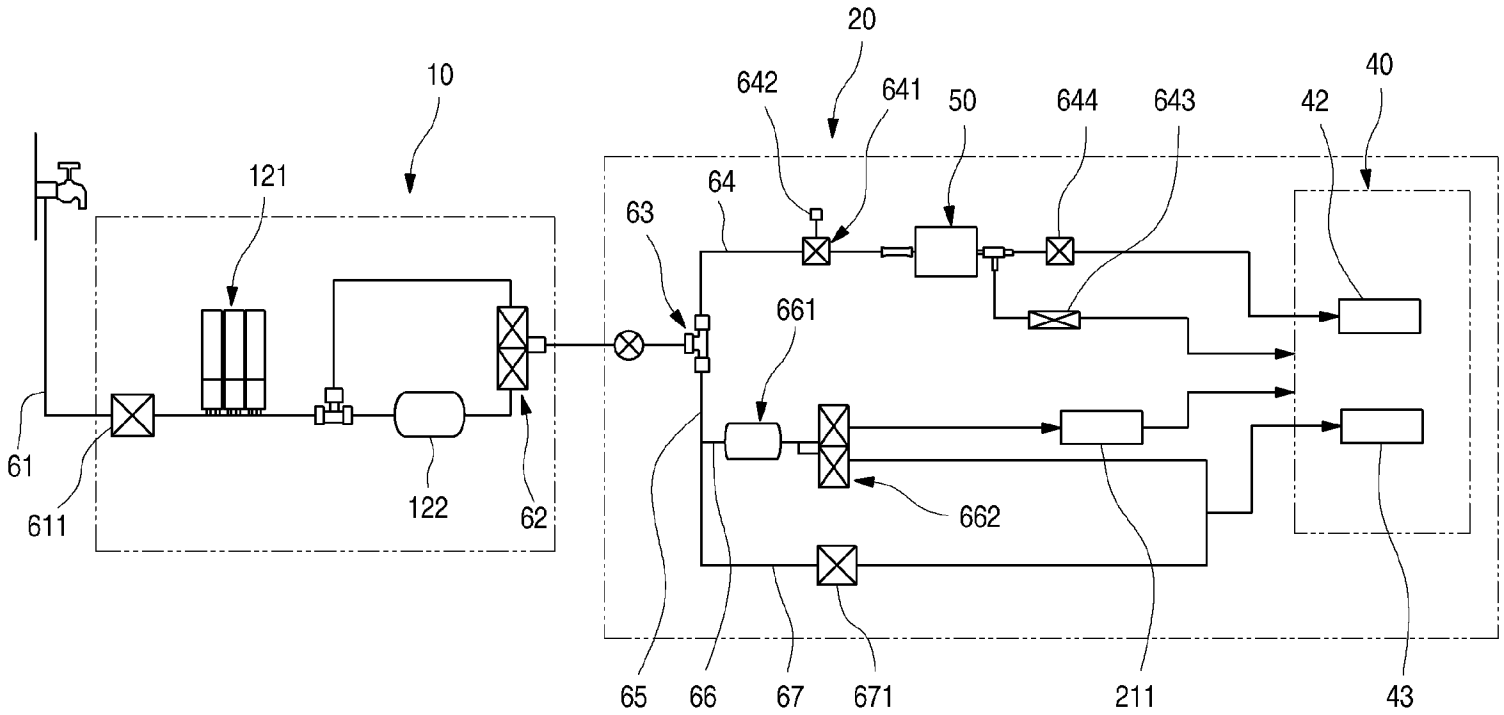
FIG. 7 is a view schematically illustrating an example path of water flow of the example refrigerator.

FIG. 7 is a view schematically illustrating an example flow path along which water of the example refrigerator flows.

As shown in the drawing, a water inlet tube 61 of the refrigerator 1 is connected to a water tube to receive original water input from the water tube. The water inlet tube 61 is connected to a pressure reducing valve 611, and the original water passing through the pressure reducing valve 611 is to decrease or reduce water pressure to a set pressure to permit an operation of the refrigerator 1.

In some examples, the pressure-reduced original water flows toward the filter 121 along a tube that connects the pressure reducing valve 611 and the filter 121. The original water passing through the filter 121 has foreign substances removed therefrom to become purified water. In some examples, the purified water is branched off to a first branch valve 62 and the cooling tank 122. The cooling tank 122 may be provided at one side of the inside of the refrigerating compartment 12, and the purified water may be stored in the cooling tank 122 to maintain a cooling state.

In some examples, the cooling tank 122 is connected to the first branch valve 62. The first branch valve 62 enables cold water or purified water to be extracted when a user performs a manipulation for extracting the cold water or the purified water. Therefore, when the user performs a manipulation for extracting purified water, the first branch valve 62 is switched such that the water purified by the filter 121 can be supplied. When the user performs a manipulation for extracting cold water, the first branch valve 62 is switched such that the cold water stored in the cooling tank 122 can be supplied. In some implementations, even when the user performs a manipulation for extracting hot water, the first branch valve 62 may be switched such that the water purified by the filter instead of cold water can be supplied.

A tube connected to an exit of the first branch valve 62 may be guided or extend to the refrigerating compartment door 20 by passing through a door hinge. In some examples, the tube extending to the refrigerating compartment door 20 may be branched off into a hot water tube 64 and a cold/purified water tube 65 by a branch tube 63.

In some implementations, the cold/purified water tube 65 may be branched off into a cold water tube 66 and a purified water pipe 67. The cold water tube 66 may be connected to the auxiliary cooling tank 661 provided at the refrigerating compartment door 20, and water additionally cooled in the auxiliary cooling tank 661 may be supplied to the ice maker 211 and the cold/purified extraction nozzle 43 of the dispenser 40 through a second branch valve 662. That is, water cooled in the cooling tank 122 may be additionally cooled in the auxiliary cooling tank 661. The additionally cooled water may be supplied to the ice maker 211 or be extracted to the dispenser 40 through the cold/purified water extraction nozzle 43 when the user performs a manipulation for extracting cold water.

In some examples, the purified water tube 67 may be connected to the cold/purified extraction nozzle 43, and the supply of water may be controlled by opening/closing of a purified water valve 671. Therefore, purified water supplied by the first branch valve 62 when the user performs a manipulation for extracting purified water may flow toward the cold/purified extraction nozzle 43 through the purified water tube 67 and be extracted to the dispenser 40 according to the opening/closing of the purified water valve 671.

In some implementations, the flow rate control valve 641 may be provided to the hot water tube 64 connected to the branch tube 63. The flow rate control valve 641 is opened when the user performs a manipulation for extracting hot water such that water can be supplied to the induction heating assembly 51, more specifically, the hot water tank 54. In this case, the water inlet temperature sensor 642 provided at the flow rate control valve 641 may sense a temperature of supplied water, and allow water with a set flow rate to be supplied to the hot water tank 54.

At the same time when the supply of water to the hot water tank 54 is started, the control assembly 52 drives the induction heating assembly 51, and water in the hot water tank 54 is heated up to a set temperature. In this case, the output of the induction heating assembly 51 may be controlled according to the flow rate, temperature, and set target temperature of water input into the hot water tank 54. In some examples, the water heated to the set temperature may be extracted to the dispenser 40 through the hot water extraction nozzle 42 by opening/closing of a hot water valve 644 provided on the tube between the hot water tank 54 and the hot water extraction nozzle 42.

In some examples, steam may be generated when hot water is heated in the hot water tank 54. The steam flow toward an exit of the hot water tank 54 may be discharged to one side of the dispenser 40 through the safety valve 643.

Various other implementations may be applied in addition to the above-described implementations of the present disclosure.

Another implementation of the present disclosure has a structure in which the hot water module may be mounted through the recessed part of the dispenser. Components of the implementation are identical to those of the above-described implementation except a structure of the dispenser case. Therefore, detailed descriptions of the identical components will be omitted to avoid redundancy, and the identical components are designated by like reference numerals.

Figure 8:
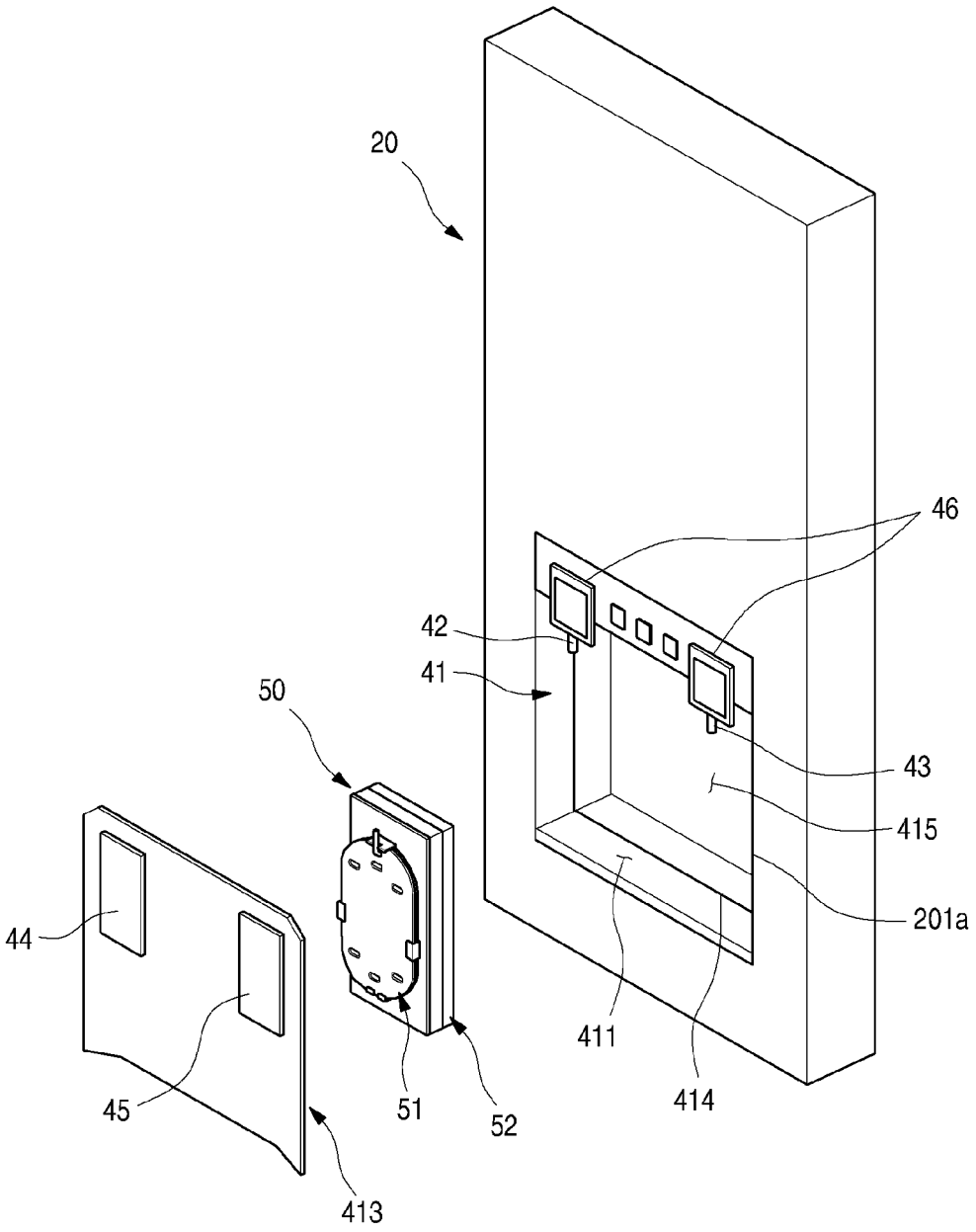
FIG. 8 is an exploded perspective view showing another example hot water module and its mounting state.

FIG. 8 is an exploded perspective view illustrating an example mounting state of another example hot water module.

As shown in the drawing, a dispenser is provided at a front surface of a refrigerating compartment door 20 of an example refrigerator 1 according. Also, an appearance of the dispenser may be formed by a dispenser case 41, and a recessed part 411 that forms a recessed space in which the supply of water is performed may be formed by the dispenser case 41.

A display 46 may be provided at an upper portion of the dispenser case 41, and a cold/purified water extraction nozzle 43 and a hot water extraction nozzle 42, which protrude to the recessed part 411, may be provided at inner upper surface of the recessed part 411.

In some examples, a wall plate 413 may be provided to form rear wall of the recessed part 411. The wall plate 413 may be mounted in the recessed part 411 of the dispenser case 41 to form the rear wall of the recessed part 411, and a hot water extraction member 44 and the cold/purified water extraction member 45, which allow a user to perform a manipulation for extracting hot water or cold/purified water, may be mounted to the wall plate 413.

In some implementations, a stepped part 414 at which the wall plate 413 is mounted may be formed at the rear circumference of the recessed part 411 of the dispenser case 41. The wall plate 413 is mounted at the stepped part 414 to form the recessed part 411, and shields a module mounting part 415 in the dispenser case 41.

The module mounting part 415 may be covered by the wall plate 413. That is, an internal space of the dispenser case 41 may be divided or partitioned into the recessed part 411 at the front thereof and the module mounting part 415 at the rear thereof by the wall plate 413. In this case, the module mounting part 415 is located rearward of the recessed part 411.

The module mounting part 415 may be formed as one side of the dispenser case 41, and be recessed further than the recessed part 411. In some examples, the module mounting part 415 may be recessed to have a size and a depth where a hot water module 50 can be mounted.

In some examples, the hot water module 50 may be accommodated in the module mounting part 415. The hot water module 50 may include an induction heating assembly 51 and a control assembly to be integrally coupled. In some examples, the induction heating assembly 51 having a relatively high temperature may be disposed adjacent to the wall plate 413. Thus, a space in the refrigerator can be prevented from being increased by heat generated in driving of the hot water module 50.

The wall plate 413 may be mounted after the hot water module 50 is mounted in the module mounting part 415. The wall plate 413 forms a rear wall of the recessed part 411 and covers a front opening of the module mounting part 415 as well as the hot water module 50.

In some implementations, the user can selectively extract cold water, purified water, and hot water by manipulating the dispenser.

Although some implementations of the present disclosure are described for illustrative purposes, it will be apparent to those skilled in the art that various modifications and changes can be made thereto within the scope of the disclosure without departing from the essential features of the disclosure.

Accordingly, the aforementioned implementations should be construed not to limit the technical spirit of the present disclosure but to be provided for illustrative purposes so that those skilled in the art can fully understand the spirit of the present disclosure.

The scope of the present disclosure should not be limited to the aforementioned implementations but defined by appended claims. The technical spirit within the scope substantially identical with the scope of the present disclosure will be considered to fall in the scope of the present disclosure defined by the appended claims.

What is claimed is:

1. A refrigerator comprising:

a cabinet that defines a storage space;

a door configured to open and close at least a portion of the storage space, the door including an out plate that defines an outer appearance of the door, a door liner that defines an inner surface of the door, and a heat insulating material that is filled in a space defined between the out plate and the door liner; and a dispenser located at the door and configured to dispense water or ice to an outside of the door, wherein the dispenser includes:

a dispenser case located at an outer surface of the door, the dispenser case defining an appearance of the dispenser and including a recessed part recessed from the outer surface of the door, an extraction nozzle located at an upper portion of the recessed part, the extraction nozzle being configured to enable flow of the water to the outside of the door, a hot water module located in the door at a rear portion of the recessed part, the hot water module being configured to heat, by induction heating, the water supplied to the hot water module and to supply the heated water to the extraction nozzle, and a hot water module case that accommodates the hot water module, the hot water module case coupling to a rear wall of the recessed part, at least a portion of the hot water module case being surrounded by the heat insulating material, wherein the hot water module includes:

a hot water tank that is configured to receive purified water and to pass the received purified water therethrough, the hot water tank having a flat shape, and a working coil that faces the hot water tank, that is wound multiple times about a center of the working coil, and that is configured to generate an electromagnetic field for heating the hot water tank by induction heating, the working coil having a flat shape, and wherein the hot water module is positioned between the heat insulating material and the recessed part.

2. The refrigerator of claim 1, further comprising:

a cooling tank disposed in the cabinet and configured supply cold water to the dispenser; and a door auxiliary cooling tank that is mounted on the door liner at a position corresponding to the hot water module, that faces toward the storage space, and that is configured to cool the water and store the cooled water to supply the cooled water to the extraction nozzle, wherein the door auxiliary cooling tank is connected to the cooling tank and configured to further cool the cold water supplied from the cooling tank based on heat transfer to cool air in the storage space through the door liner.

3. The refrigerator of claim 2, wherein the dispenser further includes:

a cold water module mounting part that is recessed from a portion of the door liner and located rearward of the hot water module and that accommodates the door auxiliary cooling tank.

4. The refrigerator of claim 3, wherein the dispenser further includes a door cover that is located at the door liner and defines a portion of the inner surface of the door, the door cover covering the cold water module mounting part, and wherein the door auxiliary cooling tank has a wound tube shape and is located at a surface of the door cover.

5. The refrigerator of claim 3, wherein the extraction nozzle includes:

a first water extraction nozzle connected to the hot water module and configured to dispense the heated water; and a second water extraction nozzle connected to the cold water module and configured to dispense the cooled water, the purified water, or both.

6. The refrigerator of claim 1, wherein the hot water module further includes:

a plurality of ferrite cores that are radially disposed about the center of the working coil and configured to maintain the electromagnetic field generated by the working coil; and a heating bracket that is coupled to the hot water tank, the working coil, and the plurality of ferrite cores.

7. The refrigerator of claim 6, wherein the hot water module further includes a control assembly that is coupled to the heating bracket and configured to control an operation of the hot water module, wherein the hot water tank faces toward the recessed part, and wherein the control assembly faces toward the storage space and is located rearward of the hot water tank.

8. The refrigerator of claim 1, wherein the hot water tank faces toward the rear wall of the dispenser case.

9. The refrigerator of claim 1, wherein the hot water module includes a safety valve located at an exit of the hot water tank, the safety valve being configured to communicate with the dispenser to discharge steam from the hot water tank.

10. The refrigerator of claim 1, wherein the hot water module further includes a flow rate control valve located at an entrance of the hot water tank, the flow rate control valve being configured to measure a flow rate of the water supplied to the hot water tank.

11. The refrigerator of claim 1, wherein the hot water module further includes a water inlet temperature sensor located at an entrance of the hot water tank, the water inlet temperature sensor being configured to measure a temperature of the water supplied to the hot water tank.

12. The refrigerator of claim 1, wherein the hot water tank includes:

a first cover that has a planar shape and faces the working coil; and a second cover that faces the first cover and couples to a circumferential surface of the first cover, at least a portion of the second cover being recessed to define a space between the first and second covers, wherein the hot water tank is configured to enable flow of the water through the defined space between the first and second covers.

13. The refrigerator of claim 1, wherein the dispenser further includes a cold water module located at the door, the cold water module being configured to cool water supplied to the dispenser and to store the cooled water, and wherein the hot water module is disposed between the recessed part and the cold water module.

14. A refrigerator comprising:

a cabinet that defines a storage space;

a door configured to open and close at least a portion of the storage space, the door including an out plate that defines an outer appearance of the door, a door liner that defines an inner surface of the door, and a heat insulating material that is filled in a space defined between the out plate and the door liner; and a dispenser provided at the door and configured to dispense water or ice to an outside of the door, wherein the dispenser includes:

a dispenser case located at an outer surface of the door, the dispenser case defining an appearance of the dispenser and a space recessed from the outer surface of the door, a wall plate detachably coupled to the dispenser case, the wall plate partitioning the recessed space into a recessed part in front of the wall plate and a hot water module mounting part behind the wall plate, an extraction nozzle extending from an upper portion of the recessed part, and the extraction nozzle being configured to enable flow of the water to the outside of the door, and a hot water module located at the hot water module mounting part, the hot water module being configured to heat, by induction heating, the water supplied to the hot water module and to supply the heated water to the extraction nozzle, and wherein the hot water module includes:

a hot water tank that is configured to receive purified water and to pass the received purified water therethrough, the hot water tank having a flat shape, and a working coil that faces the hot water tank, that is wound multiple times about a center of the working coil, and that is configured to generate an electromagnetic field for heating the hot water tank by induction heating, the working coil having a flat shape, wherein the hot water module is positioned between the heat insulating material and the recessed part.

15. The refrigerator of claim 14, wherein the wall plate defines a rear wall of the recessed part.

16. The refrigerator of claim 14, wherein the dispenser case includes a mounting part, the wall plate being detachably coupled to the mounting part.

17. The refrigerator of claim 14, wherein the dispenser case defines an opening at a front side of the recessed part, the wall plate being detachable from the dispenser case through the opening.

18. The refrigerator of claim 14, wherein the dispenser further includes an extraction manipulating member that is located at the wall plate and configured to enable the flow of the water through the extraction nozzle.

19. The refrigerator of claim 14, wherein the hot water module includes:

a plurality of ferrite cores that are radially disposed about the center of the working coil and configured to maintain the electromagnetic field generated by the working coil; and a heating bracket that is coupled to the hot water tank, the working coil, and the plurality of ferrite cores.

20. The refrigerator of claim 14, wherein the hot water tank faces toward the wall plate.

* * * * *